United States Patent [19]

Ausnit

[11] 3,991,801

[45] Nov. 16, 1976

[54] PLASTIC FASTENERS WITH CONNECTING WEB

[76] Inventor: Steven Ausnit, 124 E. 61st St., New York, N.Y. 10021

[22] Filed: June 23, 1975

[21] Appl. No.: 589,373

[52] U.S. Cl. ..... 150/3; 24/201 C; 229/62

[51] Int. Cl.[2] ..... A45C 13/10; B65D 33/16

[58] Field of Search ..... 150/3, 42; 24/201 C; 229/62

[56] References Cited

UNITED STATES PATENTS

| | | | |
|---|---|---|---|
| 3,172,443 | 3/1965 | Ausnit | 150/3 |
| 3,181,583 | 5/1965 | Lingenfelter | 24/201 C |
| 3,226,787 | 1/1966 | Ausnit | 24/201 C |
| 3,746,215 | 7/1973 | Ausnit | 150/3 X |

FOREIGN PATENTS OR APPLICATIONS

| | | | |
|---|---|---|---|
| 190,595 | 7/1964 | Sweden | 24/201 C |

*Primary Examiner*—Herbert F. Ross
*Attorney, Agent, or Firm*—Hill, Gross, Simpson, Van Santen, Steadman, Chiara & Simpson

[57] ABSTRACT

An improved reclosable fastener structure for bags or the like including first and second continuous strips of flexible plastic with outer sides of the strip forming opening flanges and inner sides of the strips forming bag mounting flaps, continuous fastener profiles for each of the strips including a first fastener profile integral with one surface of the first strip and a second fastener profile of a size and shape to releasably interlock with the first profile and being integrally connected with the second strip immediate its edges and a continuous interconnecting film web of substantially uniform width extending between said strips and integrally connected at its outer edges at a location between the profiles and the edges of the mounting flaps of the first and second strips.

11 Claims, 8 Drawing Figures

Fig-1
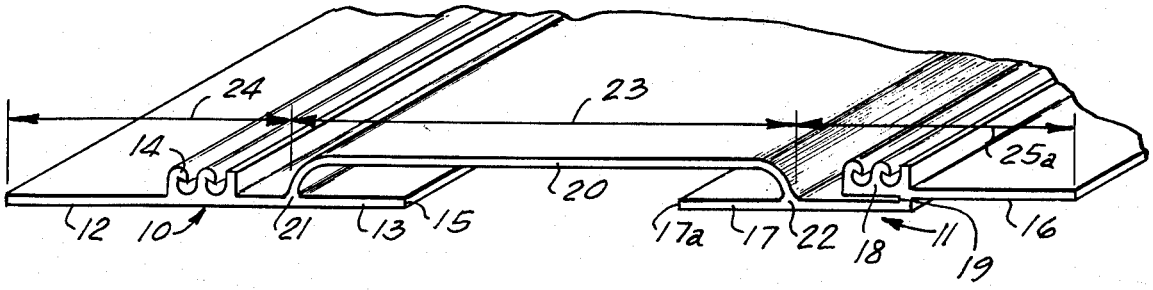
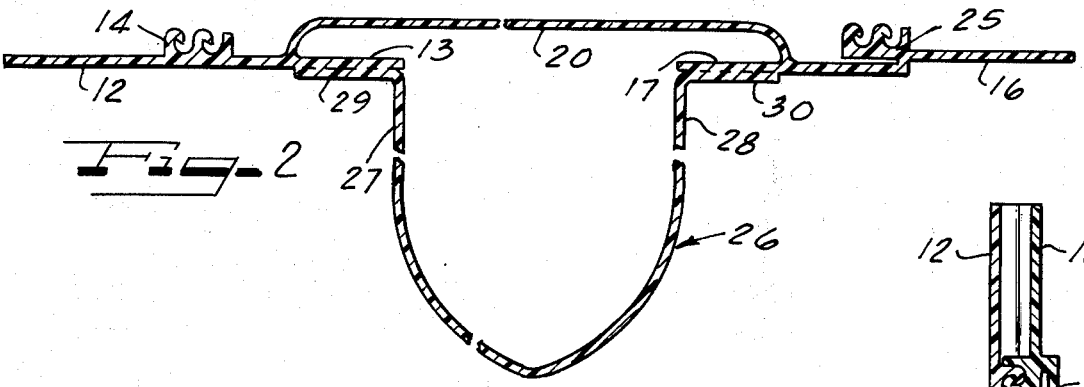
Fig-2
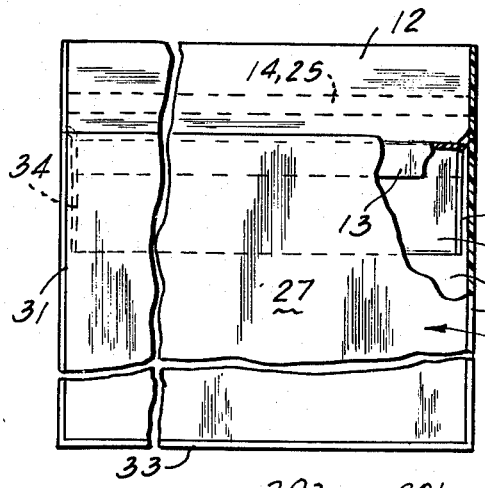
Fig-3
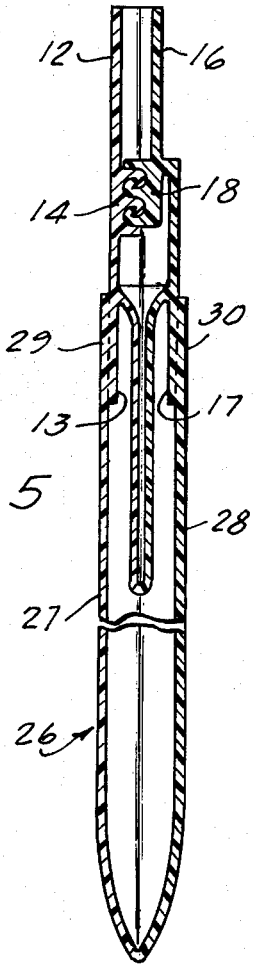
Fig-5
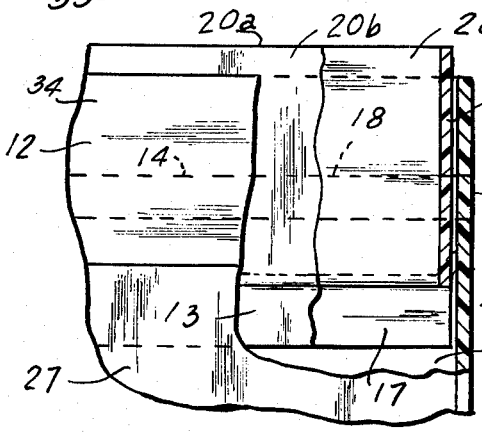
Fig-4

PLASTIC FASTENERS WITH CONNECTING WEB

BACKGROUND OF THE INVENTION

The invention relates to improvements in continuous plastic releasably interconnecting fastener strips of the type with zippers or matched shaped profiles on the surfaces adapted to be mounted on the upper edges of a bag or on a similar structure.

The invention particularly contemplates the provision of an improved closure construction for use with thin flexible film bags as are utilized for packaging merchandise marketed in stores. The bags are frequently manufactured separately, and the bag supplier brings in the flexible from another source and attaches them to the bags either prior to filling or at the time of filling. The flexible reclosable fasteners commonly come in strips which are continuous, and for convenience of handling are supplied in roll form so that they are unrolled and cut at the time of being attached to the bags. The bags will be used to contain a wide variety of materials from foodstuffs to hardware, and the materials will come in any form from liquid to fine granulated material or more large objects. The fastener strips to be satisfactory, must be easily handled and easily attached to the bags and must accommmodate the contents of the bag, that is, they must be able to close and seal the bags while remaining operative themselves so as to be reopenable and reclosable. In certain types of contents, it is essential to provide a fastener which will seal the interior of the bag and prevent inadvertent or unintentional opening before use. Different developments have been attempted to accomplish this purpose, such as by providing plastic elements which temporarily hold the fastener profiles together or actually sealing the separating openings flanges of the profiles together until such time as the bag is used. Each of these constructions have presented some difficulties, and frequently are not suited to all types of bag contents.

Another problem which has faced the art is the provision of a satisfactory pair of fastener strips which can be easily and conveniently handled at the time of manufacture and rolled up and stored until use. One way this is done is by first interlocking the fasteners and then rolling the strips into a roll with the strips being unrolled at time that they are attached to the bag top. In certain instances these strips have to be separated before being sealed to the bag edges, and accordingly it would be desirable to be able to spool them in this fashion, but nevertheless to be able to keep them linked together so as to prevent interwining and insure correct positioning on the reel.

It is accordingly an object of the present invention to provide an improved fastener strip construction which avoids the difficulties of constructions heretofore available in the prior art and which can be particularly easily attached to the top edges of a bag.

A further object of the invention is to provide an improved fastener strip construction wherein the strips can be handled and shipped with the profiles unlocked and separated from each other so that they do not have to be separated at the time of attachment to the bag and wherein they are still maintained in their oriented relationship for handling and attachment to the bag top.

A still further object of the invention is to provide an improved fastener strip construction wherein an interconnecting web is utilized constructed and attached so that it aids in the handling of the strips and their attachment to the bag tops, provides a sealed bag after the strips have been attached to the bag, and protects the small critically shaped profiles during attachment to the bag and from the contents after the strips are attached to the bag, and the bag has been filled. The web is so shaped and so sized so that the strips will function in an improved manner with the bag, and the profiles are continued to be protected from the bag contents after use and during the times the bag is emptied and refilled. An improved bag construction results in that a bag is provided which cannot be accidentally opened or spilled and wherein the film web acts as a safety valve permitting expansion of the bag contents and distortion of the bag sides without creating the previous risks of accidentally separating the profiles with consequent spilling of the contents or contamination thereof from foreign material.

Other objects, advantages and features, as well as equivalent structures which are intended to be covered herein, will become more apparent with the teaching of the principles of the invention in connection with the disclosure of the preferred embodiment thereof in the specification, claims and drawings, in which:

DRAWINGS

FIG. 1 is a perspective view shown partially in section of a closure strip structure having the features of the present invention;

FIG. 2 is a somewhat schematic sectional view of the fastener construction attached to a bag;

FIG. 3 is an elevational view with parts broken away of the construction of FIG. 2;

FIG. 4 is a somewhat schematic elevation showing the position of parts when the bag is to be emptied;

FIG. 5 is a somewhat schematic sectional view showing the position of parts with the profiles interlocked;

DESCRIPTION

Figure 6:
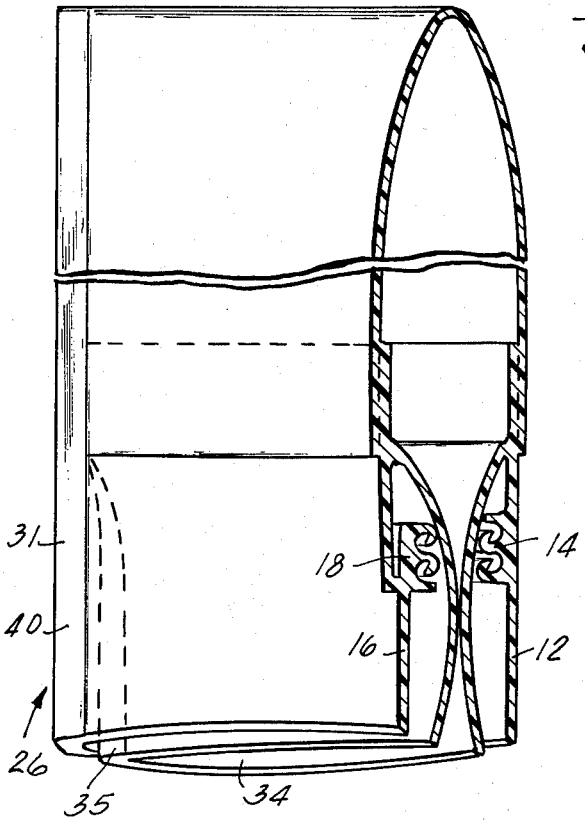
FIG. 6 is a fragmentary sectional view illustrating the relationship of parts of FIG. 4 when the bag is turned upside down to be emptied.

FIG. 1 illustrates a flexible fastener assembly including a first continuous strip 10 of flexible plastic material. The strip has an outer side or outer portion 12 which forms the opening or separating flange for the profiles when the structure is attached to the top of a bag. The strip 10 has an inner portion or side which forms a bag mounting flap 13 which is to be attached to the upper edge of a bag wall. The flap 13 has an edge 15.

On the surface of the strip 10 is a continuous releasable interlocking fastener profile 14 which is preferably integral with the surface and is formed thereon during extrusion of the strip from a plastic extruder. The profile is positioned between the opening flange 12 and the mounting flap 13 of the strip.

The assembly includes a second continuous strip 11 of flexible plastic material. An outer side of the strip forms an opening flange 16, and an inner side of the strip forms a bag mounting flap 17 with an edge **17*a*. Intermediate the opening flange 16 and the bag mounting flap 17 is a second fastener profile 18. The second fastener profile 18 is of a size and shape to releasably interlock with the first fastener profile 14, and these profiles are shown as preferably having a pair of shaped ribs with locking teeth thereon, and beside the ribs are grooves to receive the ribs of the other profile with the groove shaped to releasably interlock the profiles to each other when they are pressed together. In the type of profile shown, closing is usually accomplished manually by pressing the outer surfaces of the profile together. The profiles are separated by pulling outwardly on the opening flanges 12 and 16.**

The profile 18 is preferably connected to its strip 11 along a hinge 19 at its outer edge, with the hinge connecting the profile 18 to the strip 11 between the opening flange 16 and the mounting flap 17. The normal unstressed position of the profile 18 is lying along the surface of the flap 17 parallel thereto. This construction provides a secure closure for bag which opens more easily from the outside of the bag than from the inside, as disclosed in various prior art patents, such as Ausnit, U.S. Pat. Nos. 3,172,443 and 3,226,787.

Extending between the first and second strips 10 and 11 is a continuous interconnecting film web 20. The web is of substantially uniform width, and is integrally connected to the strips at its outer edges at 21 and 22. The connecting location is respectively between the edges 15 and 17*a* of the mounting flaps 13 and 17 and the profiles 14 and 18. Preferably, the connection locations 21 and 22 will be a sufficient distance from the edges 15 and 17*a* so that the mounting flaps 13 and 17 have sufficient area for attaching them to the upper edges of a bag and applying a heating tool. This, however, is not a limiting factor, and the web 20 can be connected closer to the edges 15 and 17*a* with a heating tool being applied between the profiles and the point of connection of the web 20. Support for the heating tool will be provided by a plate extending either down from the top of the bag or up inwardly through the open bag bottom. A preferred construction involves a critical width of the continuous web 20 that is such that its total width is greater than the combined distances from its point of connection to the strips to the outer edges of the strips. In other words, the distance 23 which measures the total width of the web 20 is greater than the total width of the distances 24 and 25 which are the widths of the strips from the point of connection of the web 20 to the outer edges of the flanges 12 and 16. This construction permits the web 20 to be doubled and projected up beyond the profiles and/or upper edges of the flanges for cutting the web when the web is first separated for emptying the contents of the bag. The above can be accomplished either as shown in FIGS. 4 and 6, where the ends of the web have been cut and presealed at location 35 adjoining the bag side seal 32 or by leaving the web ends to be sealed with the bag side itself. In such an instance the flap has to be of greater depth than the case mentioned above so that it can extend beyond the profile grooves.

Figure 7:
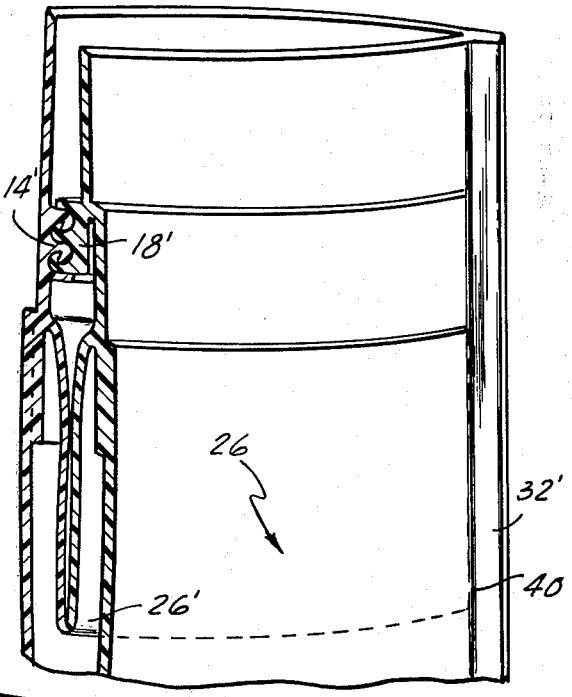
FIG. 7 is a fragmentary perspective view showing the top of the bag of modified construction where the flap is locked to the side seam of the bag.
Figure 8:
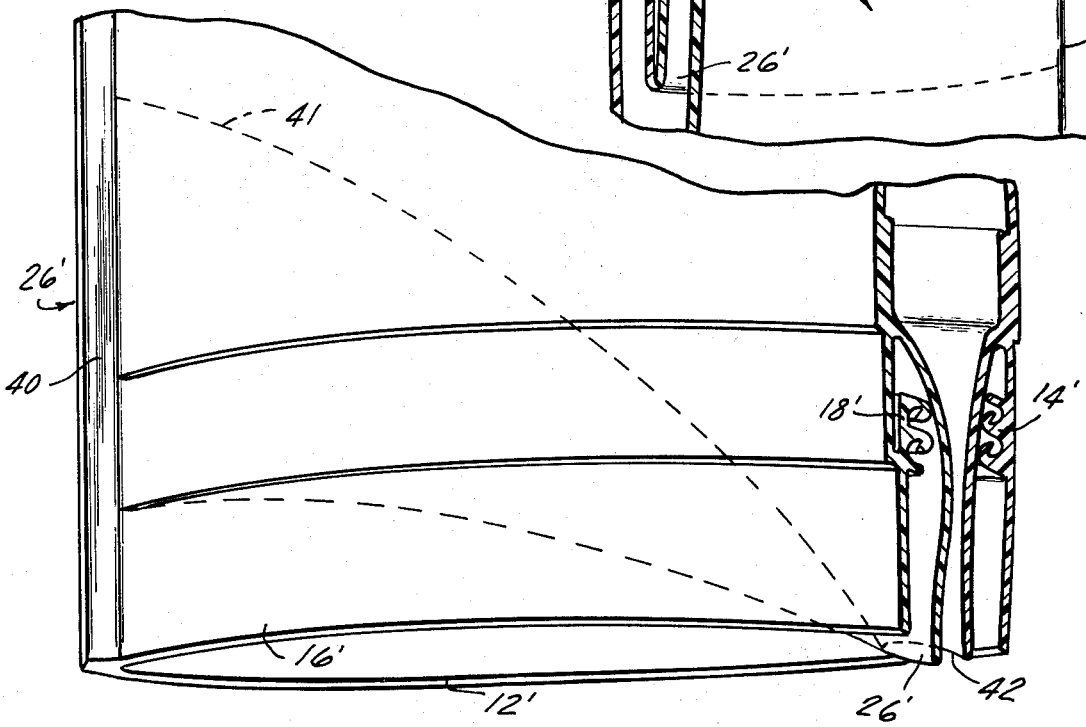
FIG. 8 illustrates the bag construction of FIG. 7 showing the relationship of the part when the bag is turned upside down and emptied.

In the arrangement of FIGS. 4 and 6, the flap 34 is not connected to the side seam of the bag, except at its base, so that it can freely drop through the opening of the bag when emptying, as shown in FIG. 6. By contrast, in FIG. 7 the side edges of the flap 26 are locked or welded to the side seams of the bag as shown at 40 wherein the flap edges 26′ are locked to the side seam 32′. The bag of FIG. 7 is otherwise of the same construction as the bag of FIGS. 4 and 6 having profiles shown at 14′ and 18′. As additional material is provided at the sides of the flap 26, an advantage is that it automatically forms a funnel when the bag is upended and poured through the open top in the manner shown in FIG. 7. The flap 26 will depend downwardly through the opening with its attached base held within the bag as shown generally at 41 in FIG. 8. The flap 26, of course, will be slit or have its top cut as shown at 42 so that the contents will pour out. This cut at 42 can be made the full width of the material extending through the open top of the bag, or a smaller cut or hole can be formed for pouring the contents and limiting the volume of flow. In both of the arrangements of FIGS. 4 and 6, and FIGS. 7 and 8, when the flap is made sufficiently long so that it extends past the top of the bag, as shown in FIGS. 6 and 8, the top edges of the bag are protected, and the profiles are protected against contact with the bag contents. When the entire contents are poured from the bag, or when a desired amount of the contents are poured, the user can then tuck the flap back into the bag and reseal it by pressing the interlocking profile elements together. These are the elements 14′ and 18′ of FIGS. 7 and 8, and the profile elements 14 and 18 in FIGS. 4 and 6.

Now, returning to a discussion of the construction of the bag of FIGS. 4 and 6, after the assembly is mounted on the bag, as shown in the position of FIG. 2, the flaps 13 and 17 have been heat sealed or otherwise suitably connected to the top edges 29 and 30 of a bag 26 having side walls 27 and 28. This permits the flange 20 to perform the function of sealing or closing the bag, and the contents are fully protected and isolated from externally located foreign elements. The bag can thus be handled without spilling the contents and can actually be packed and shipped in the condition shown in FIG. 2. Generally, the profiles can be interlocked for shipping. However, if the profiles are interlocked and pressures within the bag should force the profiles to separate accidentally, the contents will not be spilled because the bag will remain closed and sealed by virtue of the integral web 20. The web 20 is sufficiently large so that it can absorb distortion of the bag walls and pressures and forces such as which occur to a bag packed in large numbers in cartons, or which occur in the bags being roughly handled and stacked. An important feature of the invention is that the closure structure can be made of material of optimum characteristics for a reclosable fastener and yet its construction does not limit the construction of the bag. For example, a bag which must be susceptible to rough handling or carrying heavy materials can be formed of laminations of plastic and metal foil, and such bag can receive the fastener illustrated with no disadvantage as to the bag function.

I claim as my invention:

1. An intergral flexible fastener unit comprising in combination:

a first continuous strip of flexible plastic with an outer side of the strip forming an opening flange and an inner side of the strip forming a bag mounting flap;

a continuous releasable interlocking fastener profile integral with the strip on one surface thereof intermediate the sides;

a second continuous strip of flexible plastic material with an outer side of the strip forming an opening flange and the inner side of the strip forming a bag mounting flap;

a second continuous fastener profile of a size and shape to releasably interlock with the first profile, said profile being continuously integrally connected to said second strip intermediate its sides and located on one surface thereof corresponding with said one surface of the first strip;

and a continuous interconnecting film web of substantially uniform width extending between said strips and integrally connected at each outer edge respectively to the mounting flaps of said first and second strips at a location on the same surface as the profiles and between the profile and the free edge of each of the mounting flaps.

2. A flexible fastener unit constructed in accordance with claim 1:

wherein the width of said film web is greater than the sum of the distances on each strip from the location of connection of the web edge to the outer edge of said opening flange.

3. A flexible fastener unit constructed in accordance with claim 1:

wherein each of said first and second fastener profiles has a plurality of ribs and grooves thereon with the ribs adapted to receive the grooves in releasably interlocking relationship with the application of an external force pressing the ribs into the grooves.

4. A flexible fastener unit constructed in accordance with claim 1:

wherein said second fastener profile is connected to said second strip so that the normal unstressed position of the connection permits the second fastener profile to extend inwardly parallel to the second strip in the direction of the bag mounting flap.

5. A flexible fastener unit constructed in accordance with claim 1:

wherein the film web is connected at its edges to the strips joining the strips at right angles thereto so as to accommodate flexure in either direction.

6. An integral flexible extruded fastener unit comprising in combination:

a first flexible continuous strip having parallel free edges along the length thereof and a first small releasably interlocking profile element extending the length of the strip intermediate said free edges;

a second flexible continuous strip having parallel free edges along the length thereof and a second small releasably interlocking profile element extending, the length of the strip intermediate said free edges;

a portion of said first strip comprising a first bag attachment flap on the one side of said first profile and including one of said free edges;

a portion of said second strip comprising a second bag attachment flap on one side of said second profile and including one of said free edges;

and an interconnecting film web of substantial and uniform width in integral extruded unit at its outer edges with said first and second flaps respectively and being on the surfaces facing each other when said profiles are in facing position with the web edges spaced upwardly from the free edges of the flaps a distance sufficient to leave a flap surface wide enough for attachment of a bag top to either surface of the flap, each said first and second strips including an opening flange on said strip on the side of said profile element opposite said flap.

7. A flexible fastener unit constructed in accordance with claim 6:

wherein the width of said film web is such that when doubled its width is sufficient to extend beyond the profile elements when the profile elements are in opposing position.

8. A bag construction comprising, in combination: a flexible plastic film bag body having side walls with upper free edges;

a first continuous strip of flexible plastic with an outer side of the strip forming an opening flange and an inner side of the strip forming a bag mounting flap;

a continuous releasable interlocking fastener profile integral with the strip on one surface thereof intermediate the sides;

a second continuous strip of flexible plastic material with an outer side of the strip forming an opening flange and the inner side of the strip forming a bag mounting flap;

a second continuous fastener profile of a size and shape to releasably interlock with the first profile, said profile being continuously integrally connected to said second strip intermediate its sides and located on one surface thereof corresponding with said one surface of the first strip;

and a continuous interconnecting film web of substantially uniform width extending between said strips and integrally connected at each outer edge surface respectively to the mounting flaps of said first and second strips at a location on the same surface as the profiles and between the profile and the free edge of each of the mounting flaps;

and said upper edges of said bag body being secured in face-to-face seam to said flap surfaces of said bag mounting flaps.

9. A bag construction in accordance with claim 8:

wherein the width of said film web is sufficient to extend beyond the fastener interlocking profiles when doubled therebetween.

10. A bag construction in accordance with claim 8:

wherein the end edges of said film web are free of connection to the side walls of the bag except at said flaps so that said web is free to pass between the profiles at its outer edges when the bag is emptied.

11. A bag construction in accordance with claim 8:

wherein the end edges of the film web are attached to the bag wall along the height of the web so that the center portion of the web passes between the profiles when the bag is emptied and forms a funnel shaped emptying portion of the web when the web is cut.

* * * * *